US009246254B2

(12) United States Patent
Vaden

(10) Patent No.: US 9,246,254 B2
(45) Date of Patent: Jan. 26, 2016

(54) SPRING CONTACT FOR MODULAR CONNECTORS

(71) Applicant: Sterling A. Vaden, Black Mountain, NC (US)

(72) Inventor: Sterling A. Vaden, Black Mountain, NC (US)

(73) Assignee: Optical Cable Corporation, Roanoke, VA (US)

( * ) Notice: Subject to any disclaimer, the term of this patent is extended or adjusted under 35 U.S.C. 154(b) by 0 days.

(21) Appl. No.: 14/217,340

(22) Filed: Mar. 17, 2014

(65) Prior Publication Data

US 2014/0273661 A1 Sep. 18, 2014

Related U.S. Application Data

(60) Provisional application No. 61/794,363, filed on Mar. 15, 2013.

(51) Int. Cl.

| | |
|---|---|
| ***H01R 24/62*** | (2011.01) |
| ***H01R 13/33*** | (2006.01) |
| ***H01R 13/6466*** | (2011.01) |
| ***H01R 24/64*** | (2011.01) |

(52) U.S. Cl.

CPC ..... *H01R 13/33* (2013.01); *H01R 13/6466* (2013.01); *H01R 24/64* (2013.01); *H01R 2201/04* (2013.01)

(58) Field of Classification Search

CPC ..... H01R 13/33
USPC ..... 439/676
See application file for complete search history.

(56) References Cited

U.S. PATENT DOCUMENTS

2003/0119370 A1 * 6/2003 Xu et al. ..... 439/676

* cited by examiner

*Primary Examiner* — Abdullah Riyami
*Assistant Examiner* — Nelson R Burgos-Guntin
(74) *Attorney, Agent, or Firm* — The Van Winkle Law Firm; David M. Carter; William G. Heedy

(57) ABSTRACT

A jack assembly includes a top face and a bottom face defining a cavity there between for receiving a plug. The jack assembly includes a printed circuit board extending between the top and bottom faces of the jack assembly. At least one spring contact is connected to the printed circuit board and extends into the cavity. The spring contact defines a flexible curvature along a length of the spring contact, and the printed circuit board connects to the jack assembly at a pivot point allowing for angular rotation of the printed circuit board within the cavity. The angular rotation allows the jack assembly to absorb stress forces on the spring contacts. Secondary springs may be included in the jack assembly to further absorb spring contact stress forces.

13 Claims, 10 Drawing Sheets

SPRING CONTACT FOR MODULAR CONNECTORS

CROSS REFERENCE TO RELATED APPLICATIONS

This non-provisional patent application claims priority to and incorporates entirely by reference U.S. Provisional Patent Application Ser. No. 61/794,363 filed on Mar. 15, 2013, and entitled "Spring Contact for Modular Connectors".

TECHNICAL FIELD

This disclosure relates to a spring contact design for high frequency modular connectors such as plugs that fit into jacks for telecommunications signal transmission.

BACKGROUND

Jack housings utilizing spring contacts encounter consistent stress on the spring contacts due to repetitive use and due to users accidentally inserting plugs of the wrong size into the jack. A need exists in the art of plug and jack housings for mechanisms within the jack to lower the stress on spring contacts and to ensure contact integrity in the event that an improper plug is inserted therein.

Without limiting the invention disclosed herein, the art of jacks and plugs has struggled with designing spring contacts that are as "short" as possible, both physically and electrically. Furthermore, spring contacts in a jack must provide sufficient contact force under normal mating with a plug for reliable electrical contact and must have sufficient allowed deflection to avoid overstress and bending.

BRIEF SUMMARY OF THE INVENTION

In one embodiment, a jack assembly includes a top face and a bottom face defining as cavity there between for receiving a plug. The jack assembly includes a printed circuit board extending between the top and bottom faces of the jack assembly. At least one spring contact is connected to the printed circuit board and extends into the cavity. The spring contact defines as flexible curvature along a length of the spring contact, and the printed circuit board connects to the jack assembly at a pivot point allowing for angular rotation of the printed circuit board within the cavity.

In another embodiment, a jack assembly has a jack housing with a top face and a bottom face defining a cavity there between for receiving a plug, and the jack assembly includes a printed circuit board extending between the top and bottom faces of the jack assembly. At least one spring contact is connected to the printed circuit board and extends into the cavity such that the spring contact defines a flexible curvature along a length of the spring contact. Output contacts connected to the printed circuit board are accessible outside of the jack housing, and the output contacts are sufficiently flexible to define a secondary spring within the jack assembly for absorbing stress forces transmitted from the spring contact to the printed circuit board.

In yet another embodiment, a jack assembly has a top face and a bottom face defining a cavity there between for receiving a plug, the jack assembly includes a printed circuit board extending between the top and bottom faces of the jack assembly. At least one spring contact is connected to the printed circuit board and extends into the cavity. The spring contact defines a flexible curvature along a length of the spring contact, and a compensating printed circuit board extends substantially perpendicular to the printed circuit board. The compensating printed circuit board extends under a portion of the spring contact such that the compensating printed circuit board is between the bottom face of the jack housing and the spring contact. The compensating printed circuit board is a secondary spring in relation to said spring contact.

DETAILED DESCRIPTION

Figure 1:
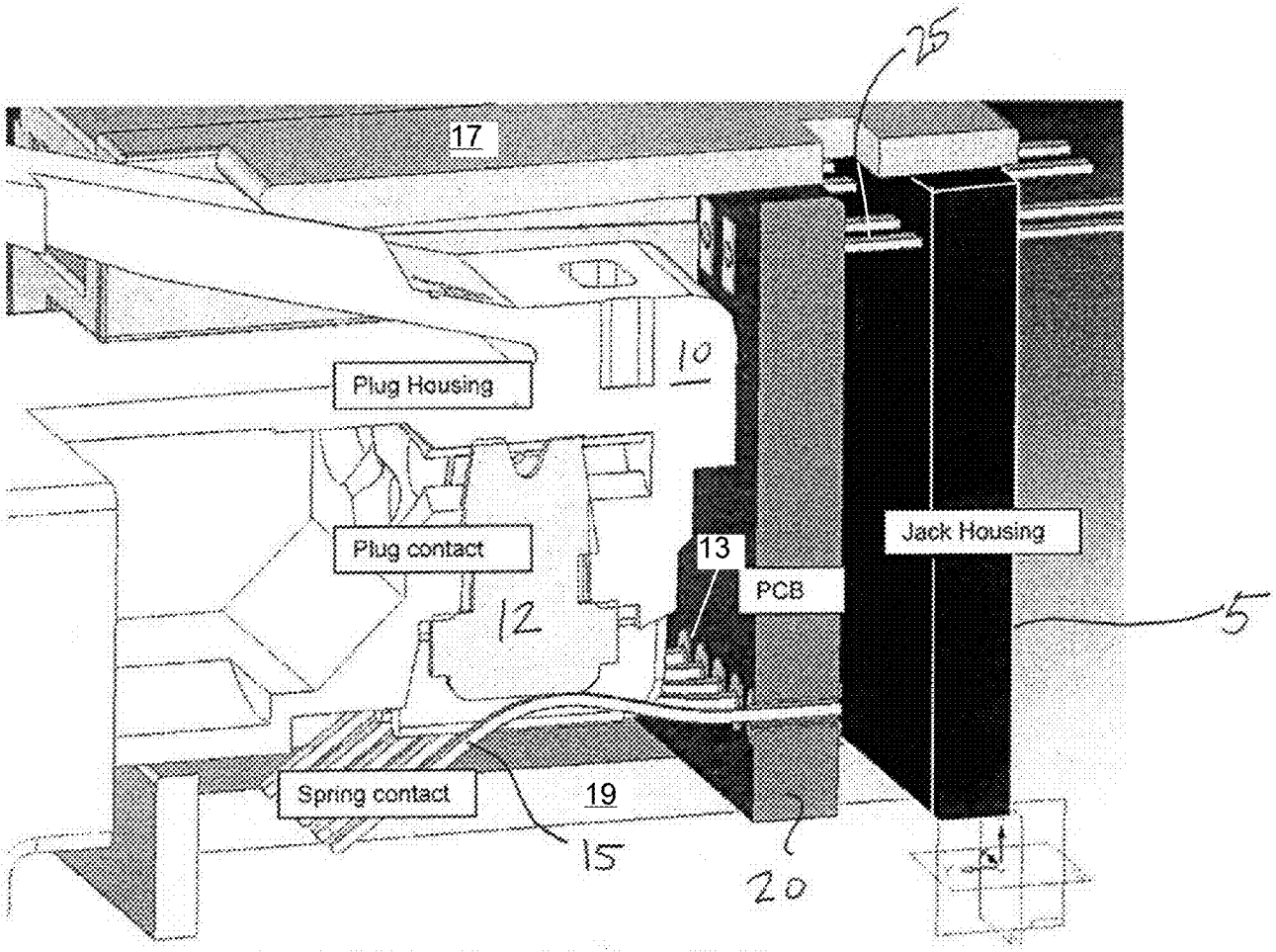
FIG. 1 PRIOR ART
FIG. 1 illustrates a prior art standard design of a modular plug and jack interface.

The following features are set forth in more detail in the detailed description below:

(i) A female jack connector (5) utilizing electrical contacts (15);

(ii) Electrical contacts (15) in the female connector jack (5) relying on a flexible beam construction (i.e., a spring) for contact force;

(iii) A printed circuit board (PCB) or other mounting for the spring contacts (15) including compensation elements (30, 35, 40);

(iv) The printed circuit board (20) being allowed to move to absorb force and deflection of the spring contacts (15);

(v) A secondary spring (35) or support (40) for the printed circuit board (30) that provides resistance to movement of the printed circuit board (30), but allows movement of the printed circuit board (30) such that the spring contacts (15) are not overstressed.

Optionally, the design disclosed herein may also include:

(vi) A secondary spring may be in the form of output contacts (25) for electrical signals;

(vii) The secondary spring may be a separate spring member (35) not electrically connected to the printed circuit board or signal paths;

(viii) The secondary spring may provide a grounding path or common connection in addition to spring force;

(ix) The PCB may be perpendicular to the nose of the plug;

(x) The PCB may be parallel to the nose of the plug;

(xi) The PCB may assume some other angle with respect to the nose of the plug;

(xii) The PCB may flex to absorb contact spring force and deflection, thus the PCB itself acts as the secondary spring.

The disclosure herein sets forth a spring contact design that minimizes the physical and electrical length of the signal travel through the spring contact (15) from a corresponding plug contact (12), while also minimizing the potential for contact physical failure due to overstress from deflection cause by movement and engagement of the contact spring. The desire is to make the spring contact as physically short as possible. This conflicts with the need to have a longer contact spring, so that the deflection of the spring by insertion of the plug does not cause overstress failure of the contact spring.

In the design of connectors, especially RJ-45 style modular plug and jack connectors, it is desirable to reduce the length of the spring contact (15) in the jack (5) portion of the connection as much as possible to improve the high frequency electrical performance. This is reflected in crosstalk ("near end cross talk or NEXT" and "far end cross talk or FEXT") performance, as well as return loss performance. Particularly in the case of NEXT performance, compensation is provided in the jack (5) by electro-magnetic (both capacitive and inductive) couplings (13) added to the contacts (15) in the jack to compensate or cancel NEXT (and FEXT) couplings that occur mainly in the modular plug (12) portion (but also the jack contact spring portion (15)) of the connector. These compensation elements (13) are typically provided in a printed circuit board (PCB). In order for these compensation elements (13) to perform effectively at high frequencies, the electrical delay from the plug (12) to the compensation element (13) should be reduced as much as possible. This is done by making the spring contacts (15) of the jack (5) as short as is practical to connect with the modular plug contacts (12). In certain embodiments below, the output contacts (25) of a jack assembly are connected to a generally described printed circuit board (20) while the compensating hardware is installed on a separate compensating printed circuit board (30) connected to the general printed circuit board.

Figure 2:
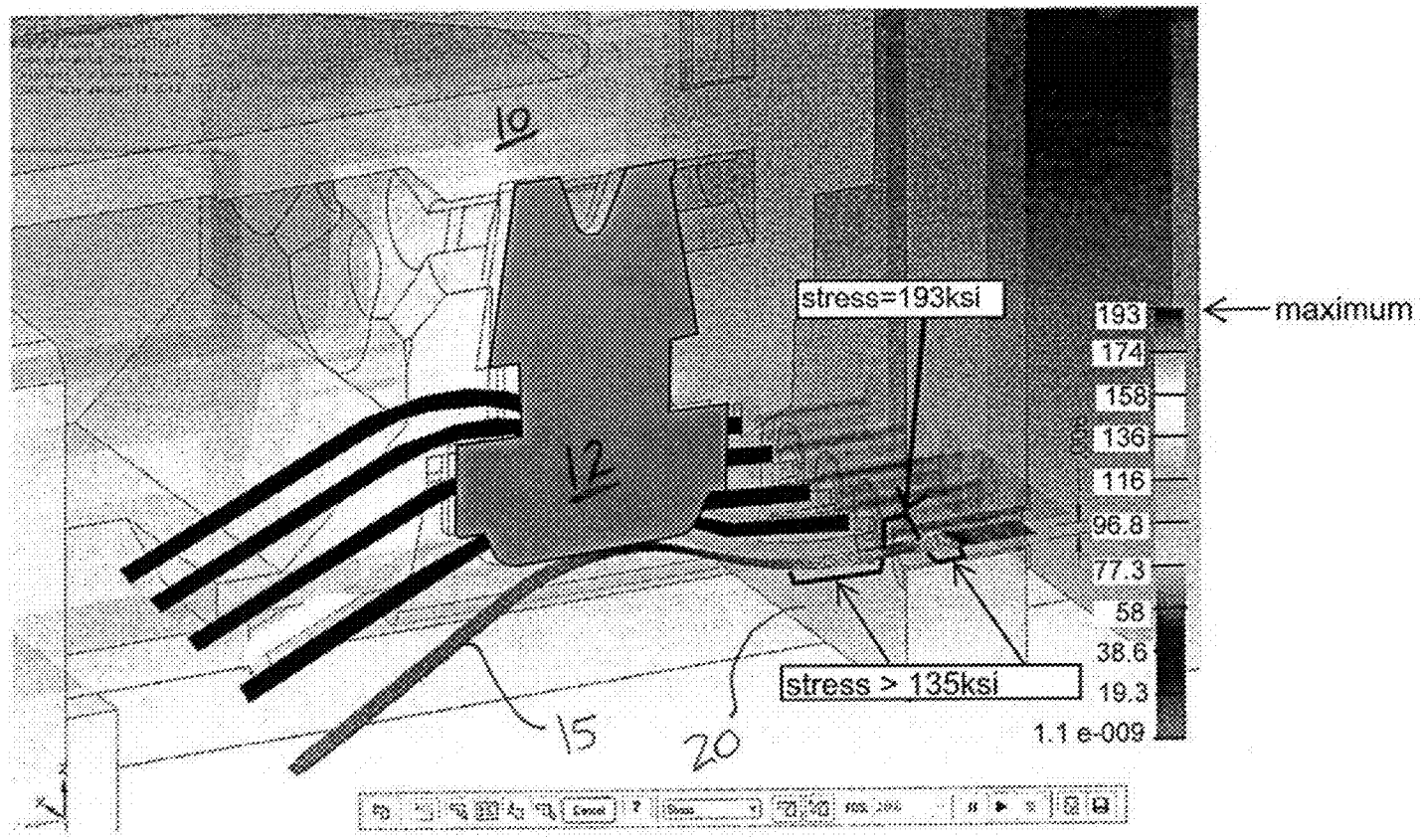
FIG. 2 PRIOR ART
FIG. 2 illustrates a stress-strain plot for the contact maximum stress of the modular jack and plug of FIG. 1.

In FIG. 2, the stress-strain plot is shown for a spring contact (15) that is relatively short and that has been deflected by a standard modular plug contact (12) wider normal mating conditions. In the figure, the maximum stress of the contact material is shown such that the graph illustrates that the maximum stress is 193 ksi (thousand pounds per square inch). The maximum allowable stress for this contact material is 115 to 135 ksi; therefore, the contact is stressed beyond its yield strength value and will become permanently bent at the point of highest stress. Afterward, it will not achieve its designed contact force. FIG. 2 shows that this design is not acceptable.

A common method of achieving an acceptable design is to lengthen the spring contact (15), whereby the contact stress is spread over a longer length for the same amount of deflection. The thickness of the contact or the material modulus of elasticity will have to be increased in order to achieve the proper design contact force. The contact design that is shown in FIGS. 1 and 2 is for illustration, and is not as long as typical spring contacts, nor as short as is desired for spring contacts. In other words the drawings are not to scale.

There are two potential problems with changing spring contact designs such that the designs become untenable as the spring contacts (15) become shorter. First, there are allowable minimum and maximum positions for the modular plug contacts (12). The jack spring contact (15) design must allow for sufficient contact force at the minimum plug contact position, while also not sustaining damage (overstress) when the contact deflection is at the maximum plug contact position. Secondly, the design of eight position modular jacks (5) must allow for the insertion of a six position modular plug which has a plug body (12) that interferes with the two outer contacts of the eight position jack without damaging the contacts. Such damage, from inserting an improper plug into the jack, may yield a permanent set of the spring contacts such that when the eight position plug is subsequently inserted, it would not make a reliable electrical connection thereafter. The profile of the nose of the six position plug is essentially similar to the shape of the plastic barriers between plug contacts shown in FIG. 1, so that the spring contacts would be pushed far beyond their intended range of deflection.

Figure 6:
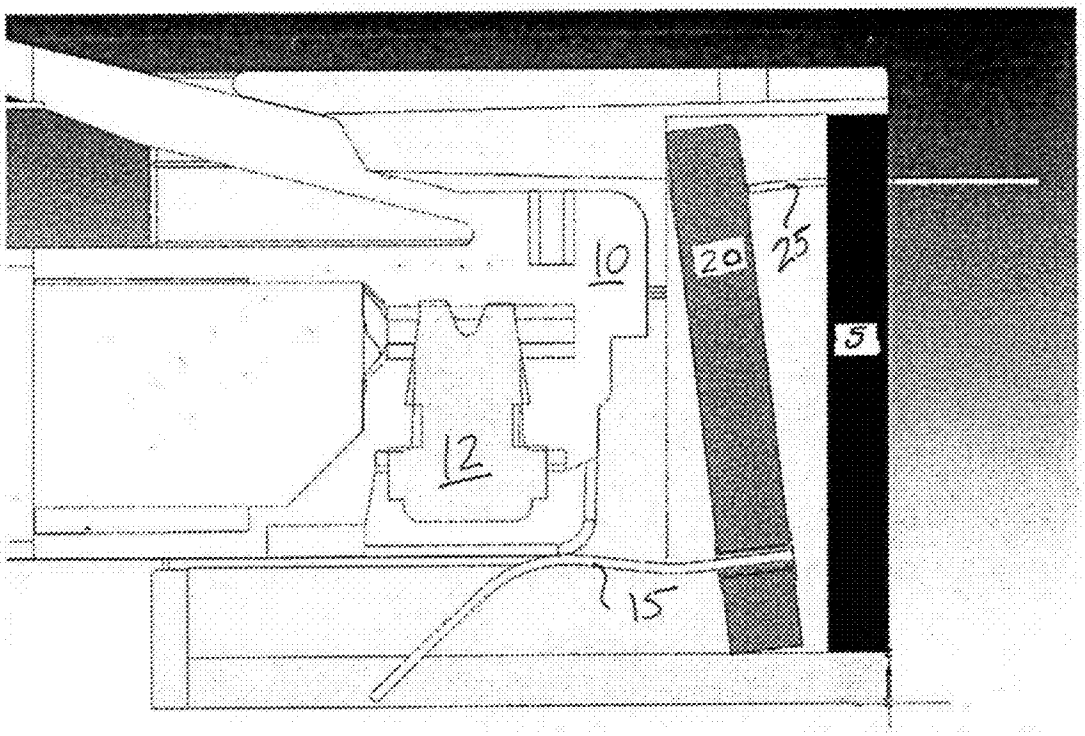
FIG. 6 illustrates a plan side view of a spring contact design with a shorter and varied shape with the printed circuit board in a deflected position due to the insertion of an ill-fitted plug.

From the preceding discussion it is known that the two goals of high frequency performance, aided by designing the spring contacts (15) as short as possible (e.g. as shown in FIG. 6), are at odds with a spring contact design that can withstand the stress of normal plug insertion at the maximum positions, especially the insertion of a six position plug that is not intended for the application, yet is commonly available in the market place. Further, it is difficult or impossible to prevent insertion of the six position plug by designing the jack (5) with interferences or obstructions within the jack.

Figure 3:
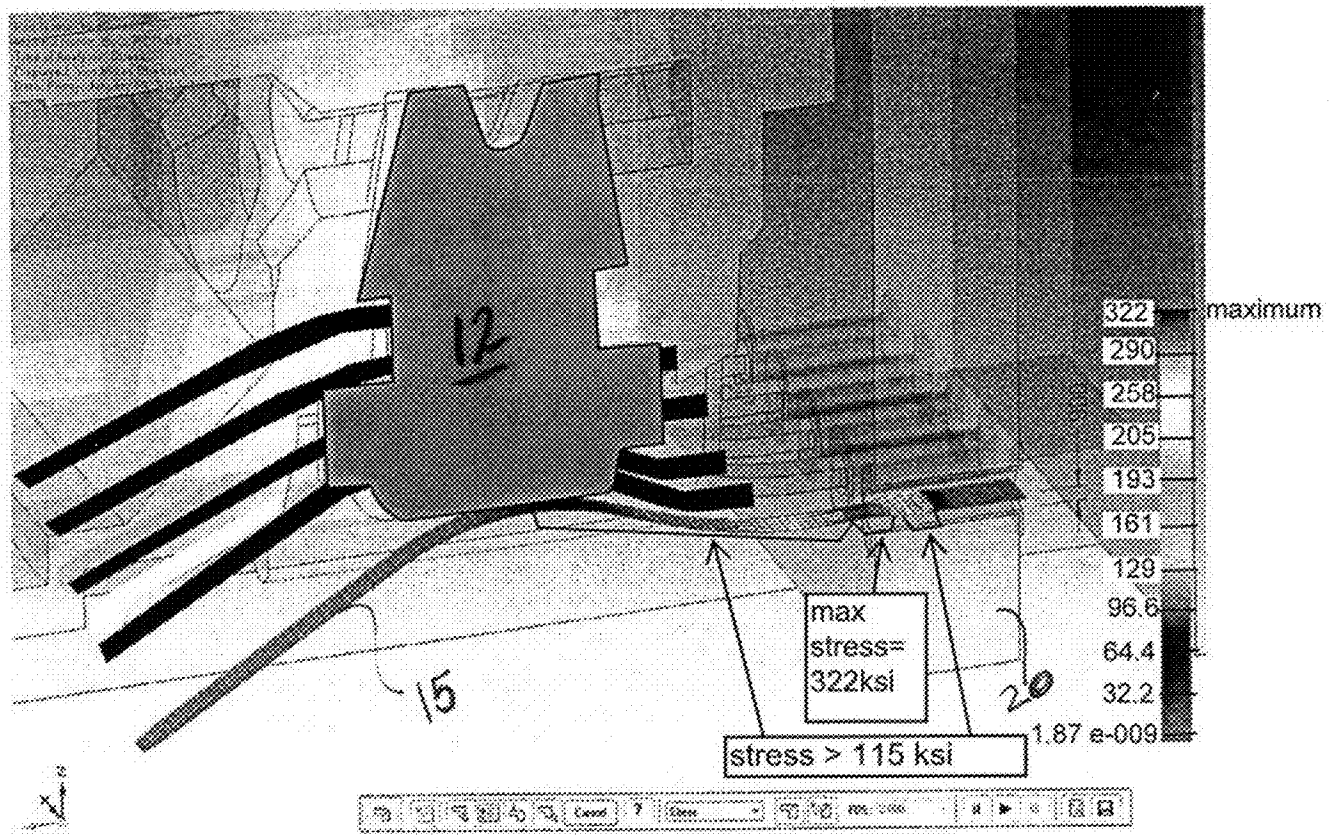
FIG. 3 PRIOR ART
FIG. 3 illustrates a stress-strain plot for the contact stress of a six position plug inserted into an eight position jack of the prior art.

FIG. 3 shows the simulation of the contact stress for the standard eight contact design when deflected by an improperly fitting six position plug. The six position modular plug has a plug body that interferes with the two outer contacts of the eight position jack (5), damages them due to over-stress, and sustains a permanent deformation of the spring contacts (15) such that when an eight position plug is subsequently inserted, it would not make a reliable electrical connection. The maximum stress is represented in the graph of FIG. 3 is 322 ksi caused by the six position plug body (12). This is 280 percent of the allowable stress for the chosen contact material. It is clear that there must be a design improvement to allow both for maximum contact deflection, and minimum contact length.

Figure 4:
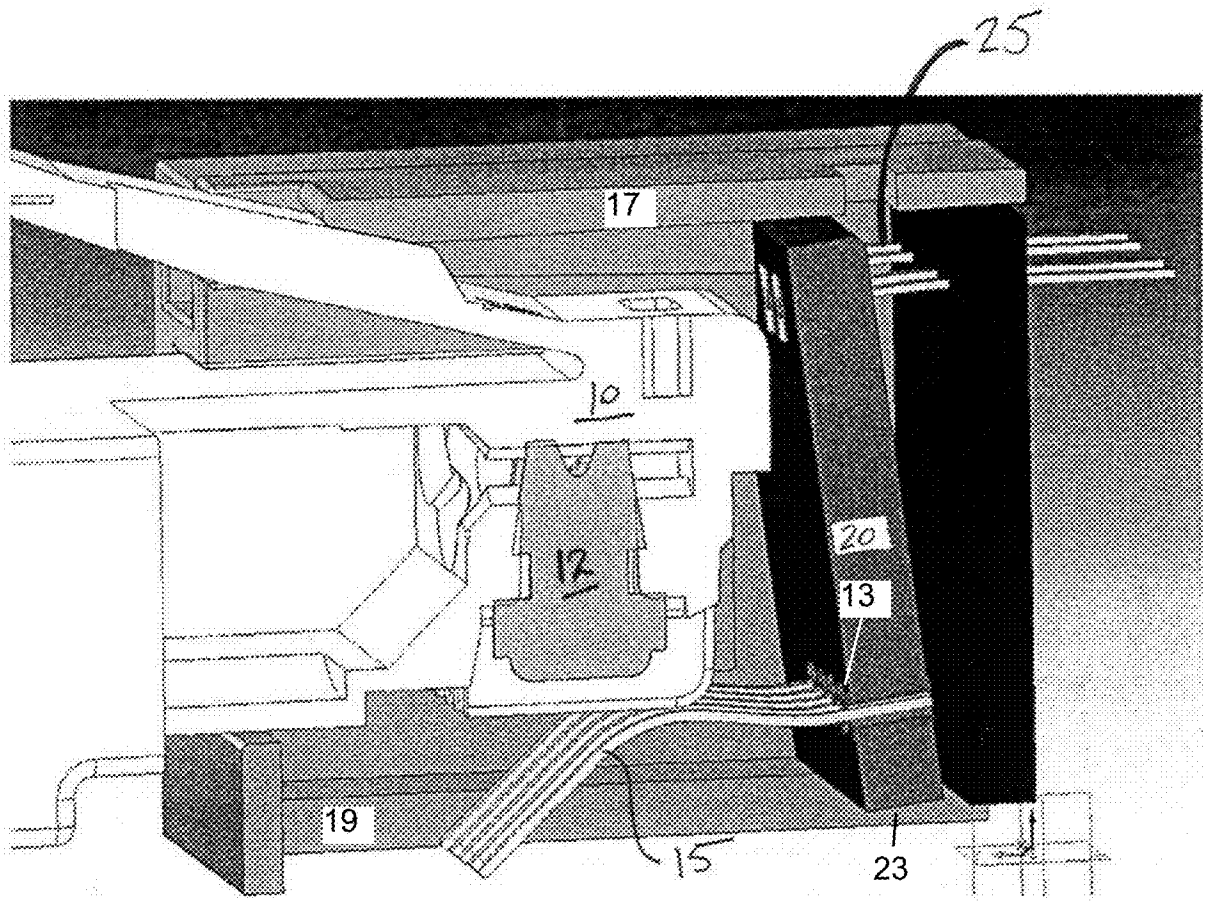
FIG. 4 illustrates a perspective side view of a plug and jack interface allowing printed circuit board deflection that removes overstress from a six position plug incorrectly inserted into an eight position jack as set forth herein.
Figure 5:
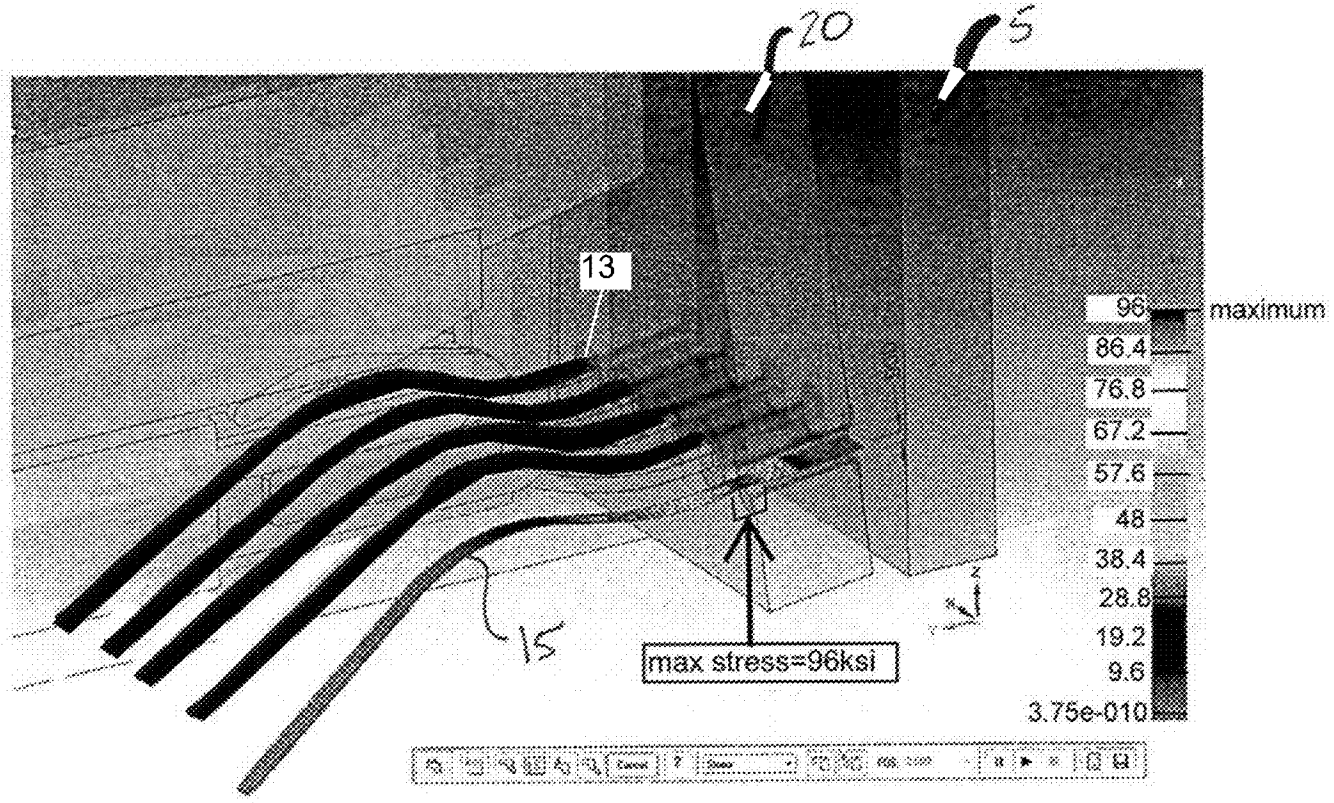
FIG. 5 illustrates a stress strain plot for the contact maximum stress from insertion of a six position plug as shown in FIG. 4 allowing the primed circuit board to deflect as set forth herein.
Figure 7:
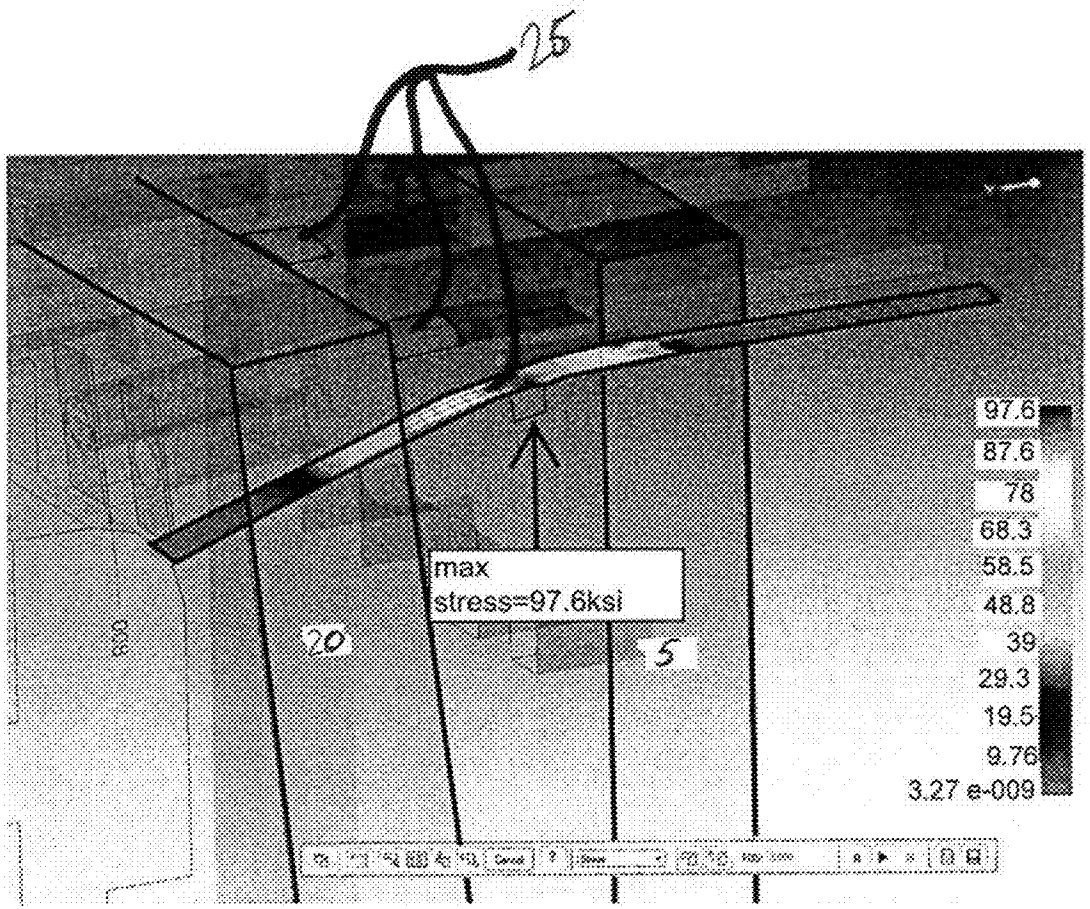
FIG. 7 shows the contact stress of an output contact between a printed circuit board and a jack housing in the embodiment of FIG. 6.

One solution, which is described herein, is to allow the printed circuit board (PCB) (20) within the connector jack (5) to absorb some of the contact (15) deflection by allowing the PCB to move within the contact housing. This movement could be accommodated by a hinged configuration connecting the printed circuit board to the jack housing (5) or the printed circuit board (20) could be made of material that is sufficiently flexible to withstand bending and deformation forces. The structure that allows the printed circuit board to pivot from a top or bottom end is shown graphically in FIG. 4. In FIG. 4, the modular jack spring contacts (15) are deflected by the insertion of the six position plug and the movement of the printed circuit board (20) to distribute some of the contact deflection forces and stress to a second set of output contacts (25) that are allowed to flex, thereby providing necessary resistance to movement of the spring contacts. In other words, by incorporating, within the PCB installation, a known degree of latitude for arcuate or angular movement of one axis of the PCB (20), PCB maintains the properly designed contact forces between the plug (12) and the jack (5) while avoiding overstress in either the spring contacts (15) or the output contacts (25). FIGS. 5 and 7 show the contact maximum stress in the spring contacts (15) and output contacts (25), respectively. When which indicate that the maximum stress of the spring contact is limited to 96 ksi, and the maximum stress of the output contact is limited to 98 ksi. Both of these values are roughly 85% of the maximum allowable stress of 115 ksi for this contact material.

Figure 8:
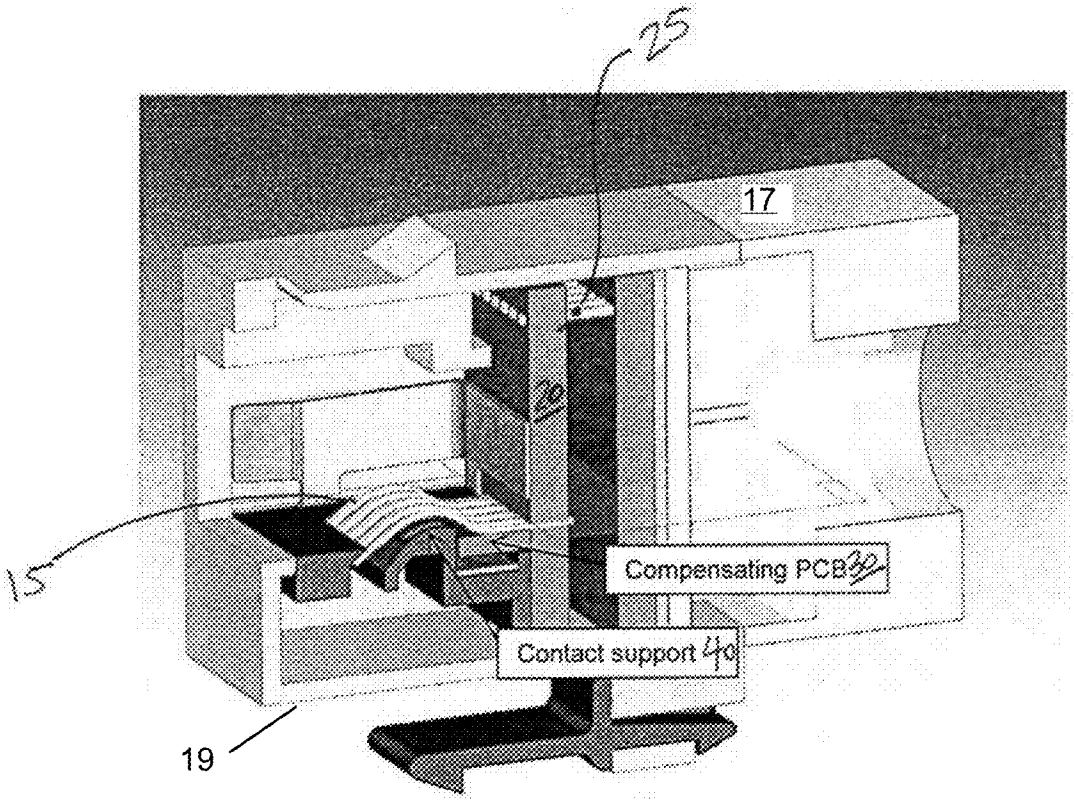
FIG. 8 illustrates a spring contact design incorporating a contact support matched with a compensating printed circuit board positioned under the spring contacts.

FIG. 8 illustrates that the compensating PCB (30) that absorbs stress may be in the form of a printed circuit board (30) that extends in a parallel direction under the spring contacts (15) of the jack (5). The printed circuit board (30), extending substantially horizontally, may be allowed to move in an angular fashion to help absorb the stress placed on spring contacts of optimal length and thickness. This, the PCB may have a spring-like function in its own construction. To meet crosstalk coupling requirements between pairs, capacitive coupling is applied between specific contacts that creates a compensating signal out of phase with the coupled crosstalk signal. The technique for doing this is the subject of prior art. For this applied coupling to be effective at high frequencies, it must be applied as close to the source of the crosstalk signal as possible. In this case the main crosstalk coupling signal is contained in the mating plug. Thus the applied crosstalk decoupling signal should be applied as close to the plug as is feasible. This is accomplished by adding a circuit board beneath the contacts as shown in FIG. 8.

Figure 9:
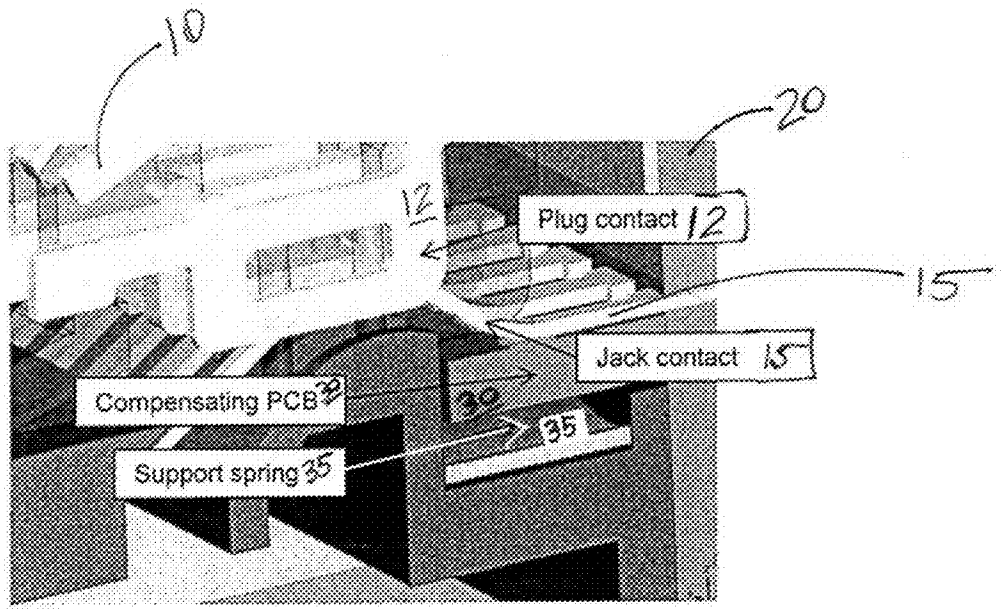
FIG. 9 illustrates the spring contact design of FIG. 8 with a view of a support spring engaging an underside of the compensating printed circuit board that absorbs stress from the spring contacts.

FIG. 8 illustrates that since the compensating PCB (30) has contacts that must remain in contact with the connector spring contacts (15), placing these contacts close to the mating point of contact with the plug effectively shortens the length of the spring contact. See the detail image of FIG. 9 showing the plug contacts in relation to the jack spring contacts. Allowing the entire contact beam (15) to deflect is a primary requirement to maintain mechanical performance of the contact. Thus a spring member (35) is placed beneath the compensating PCB (30), allowing it to move in response to forces of the deflecting contact. This spring (35) maintains adequate contact force between the compensating PCB and the jack spring contacts and also allows the PCB to move transferring some of the deflection and resultant contact stress evenly throughout the contact beam. This allows the compensation to be placed very close to the modular plug blades without compromising the spring qualities of the jack contacts.

Figure 10:
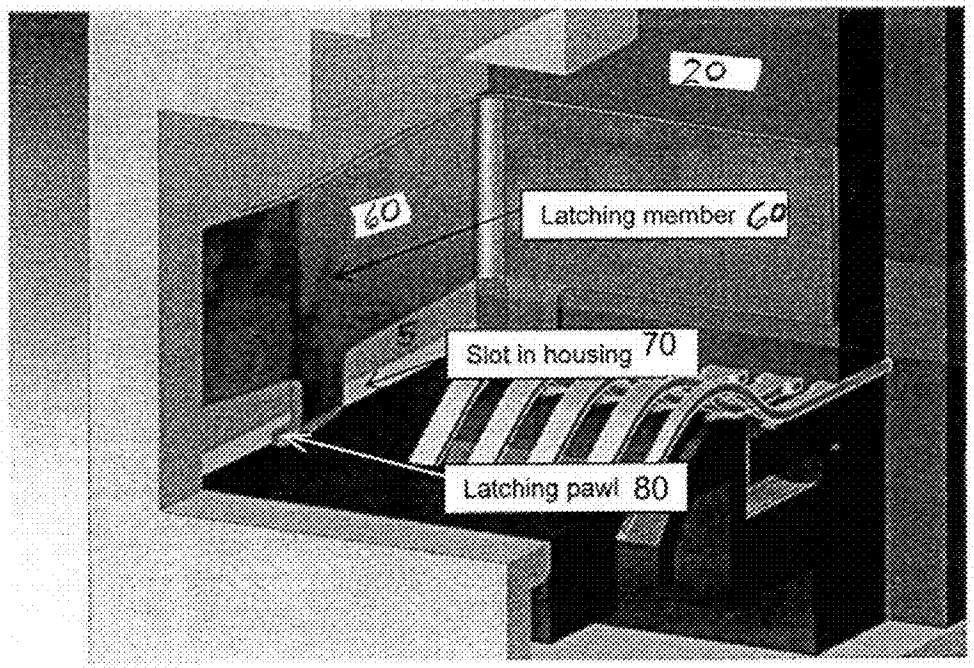
FIG. 10 illustrates a latching mechanism built into a jack housing and carrier for receiving a properly sized plug to engage the latching member into the jack housing.

Finally, as shown in FIG. 10, a mechanism is provided within the jack housing (5) that prevents the PCB/contact assembly (20) from rotating or pivoting under normal conditions with the insertion of a proper eight position plug. This restricts the PCB assembly rotation to cases where an inappropriate six position plug is inserted, or some other device not intended. This takes the shape of a latching mechanism or pawl (80) built into the side of the jack housing (5) and the carrier. The sides of the eight position plug housing push against the latching member (60 as shown in FIG. 10 as being attached to the PCB assembly (20) causing it to become engaged in a slot (70) in the housing (5) via the latching pawl (80). This restricts the movement of the PCB assembly (20). The six position plug housing is not wide enough to depress the latching member and so the PCB assembly is allowed to deflect and rotate, thus protecting the contacts from harm from the unwanted plug insertion forces.

In one embodiment, therefore, a jack assembly includes a top face (17) and a bottom face (19) defining a cavity there between for receiving a plug. The jack assembly includes a printed circuit board (20) extending between the top and bottom faces of the jack assembly. At least one spring contact (15) is connected to the printed circuit board and extends into the cavity. The spring contact defines a flexible curvature along a length of the spring contact, and the printed circuit board connects to the jack assembly at a pivot point (23) allowing for angular rotation of the printed circuit board within the cavity.

In another embodiment, a jack assembly has a jack housing with a top face (17) and a bottom face (19) defining a cavity there between for receiving a plug, and the jack assembly includes a printed circuit board (20) extending between the top and bottom faces of the jack assembly. At least one spring contact (15) is connected to the printed circuit board and extends into the cavity such that the spring contact defines a flexible curvature along a length of the spring contact. Output contacts (25) connected to the printed circuit board are accessible outside of the jack housing, and the output contacts are sufficiently flexible to define a secondary spring within the jack assembly for absorbing stress forces transmitted from the spring contact to the printed circuit board.

In yet another embodiment, a jack assembly has a top face (17) and a bottom face (19) defining a cavity there between for receiving a plug, the jack assembly includes a printed circuit board (20) extending between the top and bottom faces of the jack assembly. At least one spring contact (15) is connected to the printed circuit board and extends into the cavity. The spring contact defines a flexible curvature along a length of the spring contact, and a compensating printed circuit board (30) extends substantially perpendicular to the printed circuit board (20). The compensating printed circuit board (30) extends under a portion of the spring contact (15) such that the compensating printed circuit board (30) is between the bottom face of the jack housing and the spring contact. The compensating printed circuit board is a secondary spring in relation to said spring contact.

Similarly, the compensating printed circuit board may rest atop an actual secondary spring (35) to absorb stresses placed upon the spring contacts (15) by an associated plug in a cavity.

The above embodiments are set forth in further detail in the claim set below.

The invention claimed is:

1. A jack assembly having a top face and a bottom face defining a cavity there between for receiving a plug, the jack assembly comprising: a printed circuit board extending between the top and bottom faces of the jack assembly; at least one spring contact connected to said printed circuit board and extending into the cavity, said at least one spring contact defining a flexible curvature along a length of the at least one spring contact; a contact support extending between said bottom face and said spring contact, wherein said contact support provides resistance to movement of the printed circuit board such that said spring contact is not overstressed, and said contact support not being electrically connected to said printed circuit board; a first compensating element and a second compensating element, and wherein at least one of said first and second compensating elements is configured for electrically connecting said at least one spring contact to said printed circuit board; and wherein said printed circuit board connects to the jack assembly at a pivot point allowing for angular rotation of the printed circuit board within the cavity.

2. A jack assembly according to claim 1, wherein one of said first and second compensating elements is a compensating printed circuit board.

3. A jack assembly according to claim 1, further comprising output contacts extending from said printed circuit board.

4. A jack assembly having a jack housing with a top face and a bottom face defining a cavity there between for receiving a plug, the jack assembly comprising: a printed circuit board extending between the top and bottom faces of the jack assembly; at least one spring contact connected to said printed circuit board and extending into the cavity, said spring contact defining a flexible curvature along a length of the spring contact; a contact support extending between said bottom face and said spring contact, wherein said contact support provides resistance to movement of the printed circuit board such that said spring contact is not overstressed, and said contact support not being electrically connected to said printed circuit board; and output contacts connected to said printed circuit board and accessible outside of the jack housing, said output contacts being sufficiently flexible to define a secondary spring within the jack assembly and absorbing stress forces transmitted from said spring contact to said printed circuit board.

5. A jack assembly according to claim 4, wherein said stress forces originate from a plug inserted into the cavity of the jack assembly.

6. A jack assembly according to claim 4, further comprising a hinge connecting said printed circuit board to the jack housing, said hinge defining a pivot point about with the printed circuit board is provided a degree of latitude for angular rotation about an axis of the printed circuit board.

7. A jack assembly according to claim 6, further comprising a latching mechanism connecting said printed circuit board to the jack housing, said latching mechanism defining a latching member extending into the cavity of the jack housing.

8. A jack assembly according to claim 7, wherein said jack housing defines a slot in which said latching member fits to secure said latching member to said jack housing and removing the degree of latitude for angular rotation afforded the printed circuit board.

9. A jack assembly having a top face and a bottom face defining a cavity there between for receiving a plug, the jack assembly comprising:

a printed circuit board extending between the top and bottom faces of the jack assembly;

at least one spring contact connected to said printed circuit board and extending into the cavity, said spring contact defining a flexible curvature along a length of the spring contact;

a contact support extending between said bottom face and said spring contact, wherein said contact support provides resistance to movement of the printed circuit board such that said spring contact is not overstressed, and said contact support not being electrically connected to said printed circuit board;

a compensating printed circuit board extending substantially perpendicular to said printed circuit board and extending under a portion of said spring contact such that said compensating printed circuit board is between said bottom face and said spring contact; and wherein said compensating printed circuit board is a secondary spring in relation to said spring contact.

10. A jack assembly according to claim 9, further comprising a support spring supporting said compensating printed circuit board.

11. A jack assembly according to claim 9, wherein said contact support absorbs stress forces exerted upon said spring contact.

12. A jack assembly according to claim 1, wherein one of said first and second compensating elements is a secondary spring.

13. A jack assembly according to claim 1, wherein one of said first and second compensating elements is a contact support.

* * * * *